US007055415B1

(12) United States Patent
Walsh et al.

(10) Patent No.: US 7,055,415 B1
(45) Date of Patent: Jun. 6, 2006

(54) SCREWDRIVER ASSEMBLY AND METHOD WITH TORQUE MEASURING SCALE

(75) Inventors: James M. Walsh, Racine, WI (US); Chad E. Ryshkus, Oak Creek, WI (US); Adam S. Fedenia, Libertyville, IL (US)

(73) Assignee: Pilling Weck Incorporated, Horsham, PA (US)

( * ) Notice: Subject to any disclaimer, the term of this patent is extended or adjusted under 35 U.S.C. 154(b) by 0 days.

(21) Appl. No.: 10/448,880

(22) Filed: Jun. 2, 2003

Related U.S. Application Data

(60) Provisional application No. 60/441,552, filed on Jan. 23, 2003.

(51) Int. Cl.
*B25B 23/159* (2006.01)

(52) U.S. Cl. ..... 81/477; 81/467; 81/473

(58) Field of Classification Search ..... 81/477, 81/467, 473, 476, 429, 474, 436; 73/862.2
See application file for complete search history.

(56) References Cited

U.S. PATENT DOCUMENTS

| | | | | |
|---|---|---|---|---|
| 2,205,510 A | | 6/1940 | Wolfram | |
| 2,394,022 A | | 2/1946 | Storrie | |
| 2,400,978 A | | 5/1946 | Collins | |
| 2,417,402 A | | 3/1947 | Storrie | |
| 2,464,372 A | | 3/1949 | Booth | |
| 3,069,903 A | | 12/1962 | Larson | |
| 3,403,551 A | | 10/1968 | Agostini | |
| 3,577,778 A | | 5/1971 | Liepins | |
| 3,691,826 A | | 9/1972 | Grabovac | |
| 3,911,736 A | | 10/1975 | Miller | |
| 4,249,435 A | | 2/1981 | Villeneuve | |
| 4,641,538 A | * | 2/1987 | Heyraud | 73/862.26 |
| 5,048,381 A | * | 9/1991 | Allen et al. | 81/477 |
| 5,535,867 A | * | 7/1996 | Coccaro et al. | 192/56.1 |
| 6,575,042 B1 | * | 6/2003 | Rinner | 73/847 |

* cited by examiner

*Primary Examiner*—Lee D. Wilson
*Assistant Examiner*—Alvin J. Grant
(74) *Attorney, Agent, or Firm*—Baker & Hostetler LLP

(57) ABSTRACT

A screwdriver having a handle and a scale for measuring torque transmitted to a screw and having a beam-type spring for transmitting the screwing torque. The handle and spring have a lost-motion connection therebetween, and there is limit stop in that connection. The handle is sealed against the entry of debris. The method of making the screwdriver is also disclosed.

14 Claims, 5 Drawing Sheets

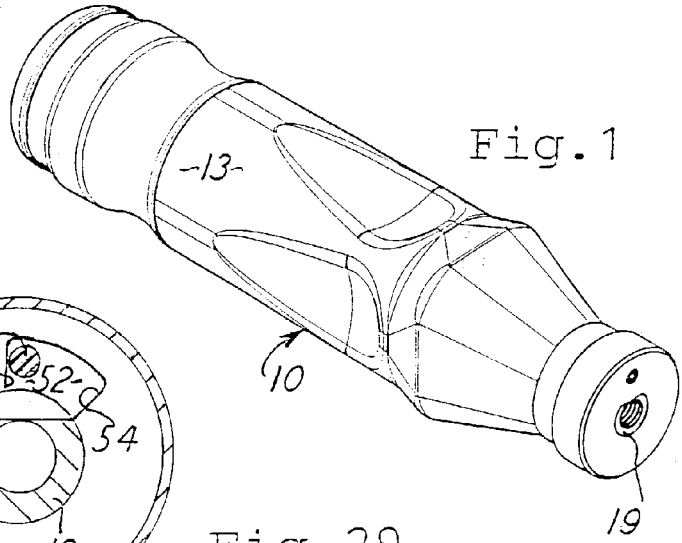
Fig.1
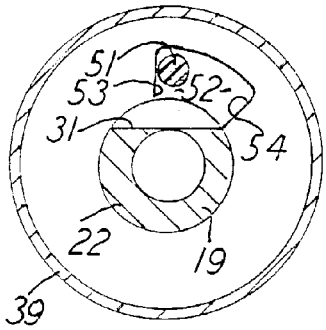
Fig.29
Fig.2
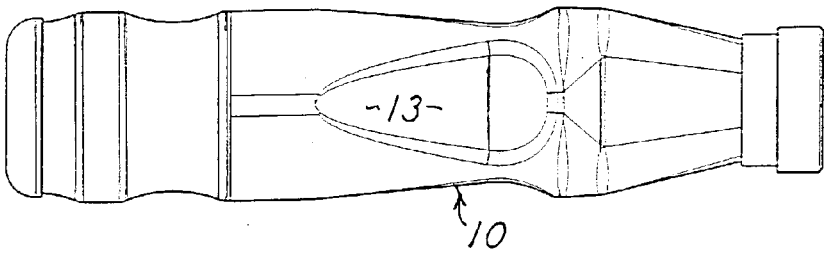
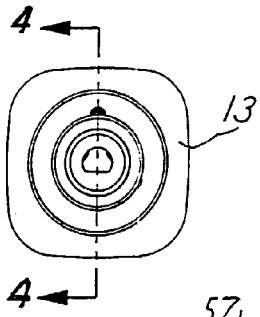
Fig.3
Fig.4
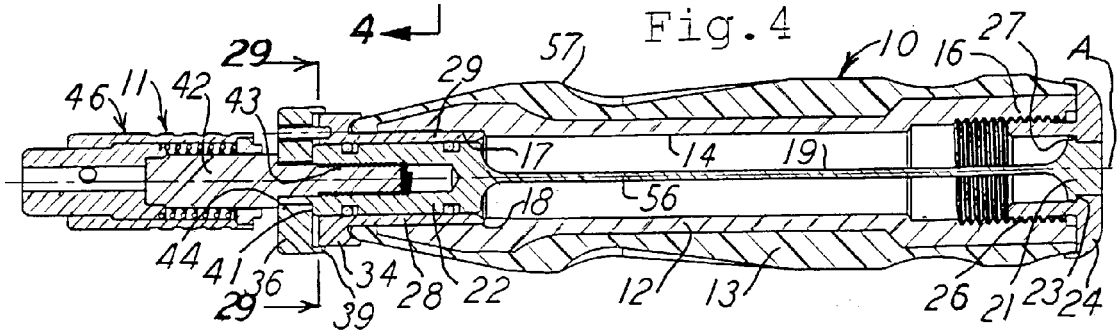

16
16

19

37
43
41
44
33
22
19
19

21
23
A 19
24
26
56
37
32
50
36
51
48
34
52
47
38
28
49
31
11
42
57
10

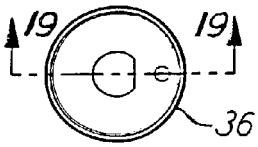
Fig.18
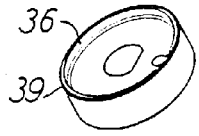
Fig.17
Fig.19
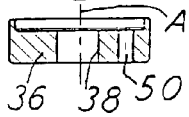
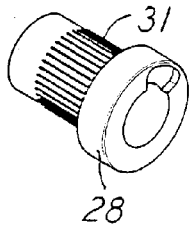
Fig.21
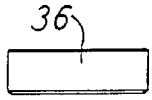
Fig.20
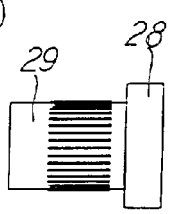
Fig.22
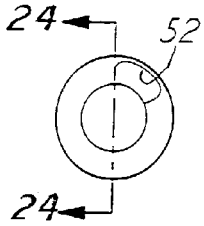
Fig.23
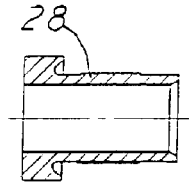
Fig.24
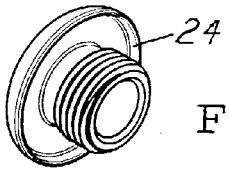
Fig.25
Fig.27
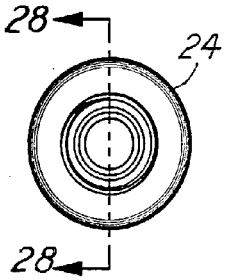
Fig.28
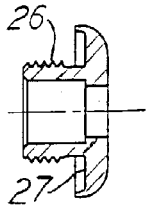
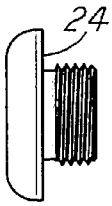
Fig.26

SCREWDRIVER ASSEMBLY AND METHOD WITH TORQUE MEASURING SCALE

This application claims the benefit of U.S. provisional application No. 60/441,552, filed Jan. 23, 2003.

This invention relates to a screwdriver assembly and method with a scale for measuring the torque applied by the screwdriver, more particularly, it relates to the assembled parts which constitute the screwdriver for transmitting variable torque to a screw and for revealing and thereby measuring the magnitudes of those torques.

BACKGROUND OF THE INVENTION

The prior art is already aware of screwdrivers which transmit and measure various amounts of torque. They employ springs through which the torque is transmitted from a screwdriver handle to the screw and by virtue of inducing tension in the spring when the handle is turned against resistance from the driven screw. A scale reveals the torque.

Because of the inherent resilience in the torquing spring, it is important the assembly with the spring be of an optimum arrangement to assure repeated usefulness of the screwdriver and repeated accuracy of torque production.

The present invention achieves the aforementioned objectives by providing a screwdriver assembly wherein the spring and the mounting thereof result in providing accuracy in torque production. Further, the accuracy is achievable in repeated uses and over a range of applied torques.

Further, this invention provides the screwdriver with features mentioned above and it does so with a screwdriver handle which is ergonomically appealing in its fit with the hand of the user such that maximum torque can be exerted by the hand and onto the screwdriver handle. Also, the handle provides for forceful gripping, even if and when itinerant liquid is on the handle. The strength of the spring, that is its resistance to torquing, is selected to be compatible with the usual strength of an ordinary user's hand.

Still further, the screwdriver of this invention is fluid-tightly sealed to preclude the entry of fluids into the interior of the screwdriver handle, and thus the screwdriver maintains its accuracy and sterility for use in the medical field, such as in applications relative to bone screws.

Additionally, the screwdriver of this invention is assembled in a manner to avoid disassembly, and thus there is no opportunity for tampering which can upset the sealed condition or the accuracy of the torque production.

Even moreso, the screwdriver of this invention is arranged for ready and accurate calibration and for limiting the amount of measurable torque transmitted and thereby avoid damage to the instrument.

Other objects and advantages will be apparent upon reading the following description in conjunction with the accompanying drawings.

BRIEF DESCRIPTION OF THE DRAWINGS

FIG. 1 is a front perspective view of the screwdriver of this invention.

FIG. 2 is a side elevational view of FIG. 1.

FIG. 3 is a front elevational view of FIG. 2 with parts added thereto.

FIG. 4 is a sectional view taken on a plane designated by line 4—4 of FIG. 3.

FIGS. 17, 21, and 25 are perspective views of parts shown in FIG. 9.

FIGS. 18, 23, and 27 are end elevational views of FIGS. 17, 21, and 25, respectively.

FIGS. 19, 24, and 28 are sectional views taken on planes designated by lines 19, 24, and 28 on FIGS. 18, 23, and 27, respectively.

FIGS. 20, 22, and 26 are side elevational views of FIGS. 17, 21, and 25, respectively.

FIG. 29 is an enlarged sectional view taken on a plane designated by line 29—29 of FIG. 4.

DESCRIPTION OF THE EMBODIMENT AND METHOD

This screwdriver is arranged with a scale to reveal the amount torque being applied to a screw. It has an ergonomically Presented handle with a rigid core and a cushioned cover, such as of silicone, and the handle is elongated and contains parts in a liquid-tight and debris-free manner. It is arranged to provide for accurate and ready setting of the "zero" starting position. There is a limited lost-motion feature which allows for the application of readable torque and also for limiting travel of the parts so that the instrument is not over strained. Adapters of varying capacity can be separately attached to the screwdriver. Throughout, the method of making the screwdriver is disclosed in the following description of the parts and their assemblage.

The first sheet of drawings shows the screwdriver of this invention which includes a handle 10 and a tool adapter 11 which is releasably connected thereto. Various adapters, such as adapter 11, can be connected with the handle 10 to accommodate and support various tools which are conventional but are not shown herein. The instrument's usefulness can be in the medical arts field for turning bone screws or the like.

Figure 8:
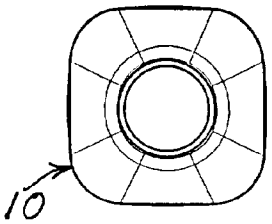
FIG. 8 is a right end elevational view of FIG. 6.
Figure 5:
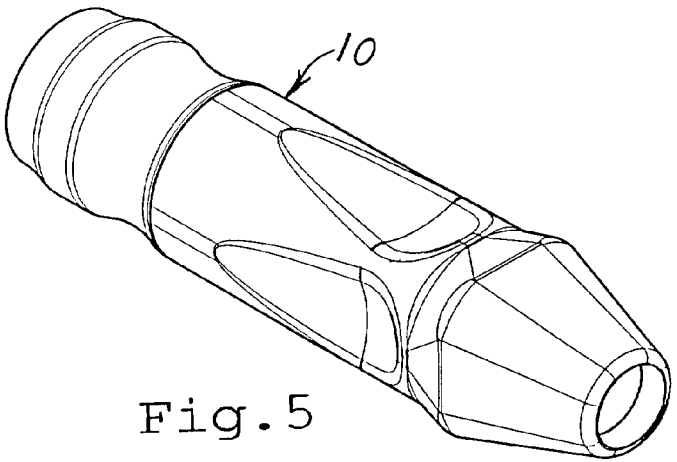
FIG. 5 is a perspective view of a part of FIG. 1.
Figure 6:
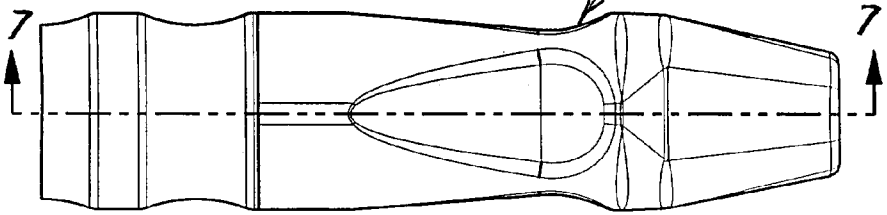
FIG. 6 is a side elevational view of FIG. 5.
Figure 7:
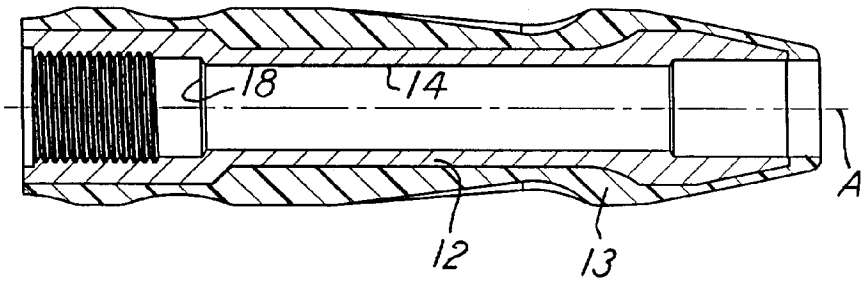
FIG. 7 is a sectional view taken on a plane designated by line 7—7 of FIG. 6.
Figures 9, 13, 14, 15, 16:
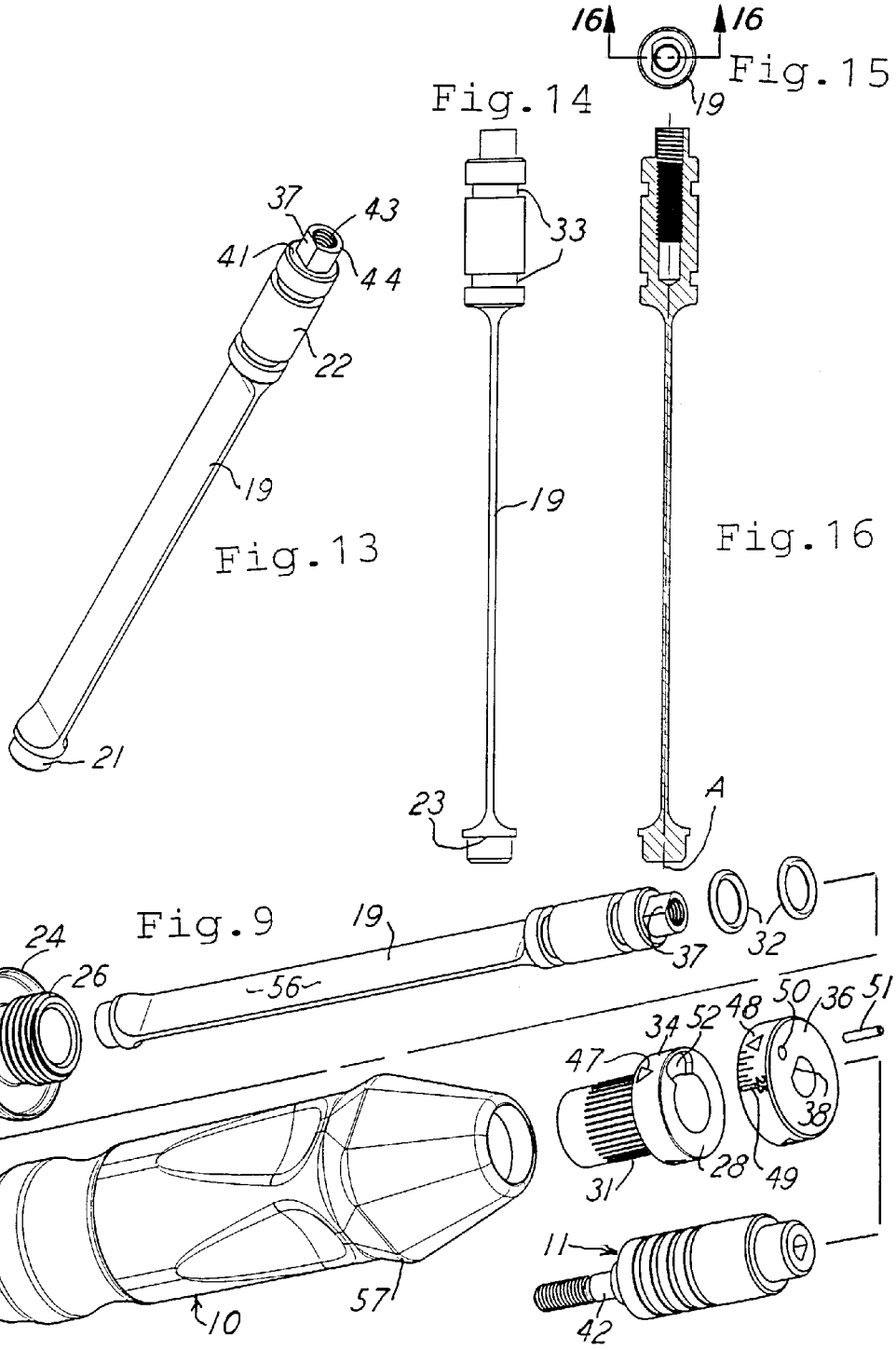
FIG. 9 is an exploded view of the assembly of FIG. 4 but from the side opposite that of FIG. 4.
FIG. 13 is a perspective view of a part shown in FIG. 9.
FIG. 14 is a side elevational view of FIG. 13.
FIG. 15 is an end elevational view of FIG. 14 but rotated ninety degrees.
FIG. 16 is a sectional view taken on a plane designated by line 16—16 of FIG. 15.
Figure 10:
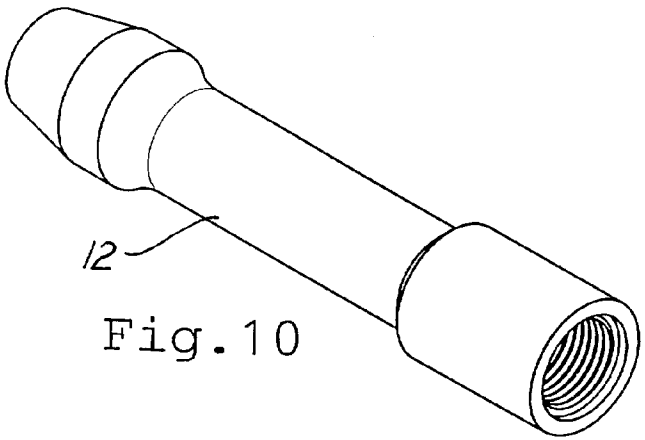
FIG. 10 is a perspective view of an internal part shown in FIG. 4.
Figure 11:
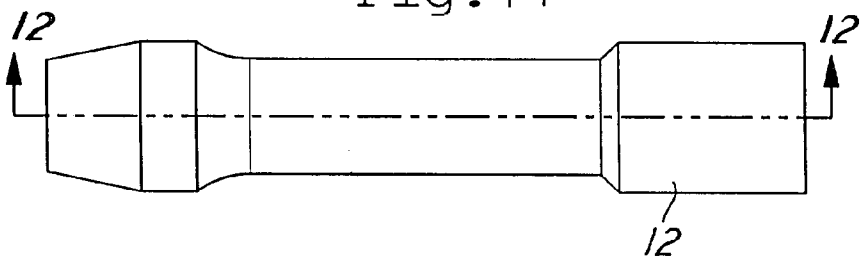
FIG. 11 is a side elevational view of FIG. 10.
Figure 12:
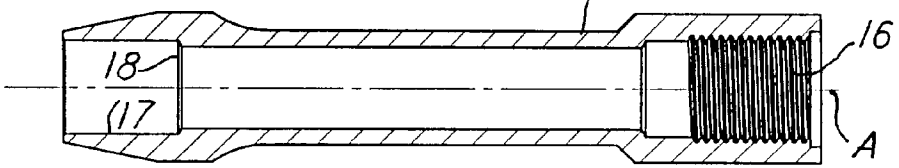
FIG. 12 is a sectional view taken on a plane designated by line 12—12 of FIG. 11.

FIGS. 4 and 9 are comprehensive in showing the invention, so initial attention is directed mainly to those two showings. The handle 10 is elongated and consists of an inner rigid and generally cylindrical core 12, such as best delineated in FIGS. 10, 11, and 12. A slightly pliable cover 13 is molded to and extends over the core 12 and is shaped to render optimum firm and powerful gripping by the user and to present an ergonomically shaped handle 10. The core 12 has a cylindrical hollow interior 14 with female threads 16 at one end, the butt end, and a countersunk cylindrical opening 17 with a circular shoulder 18 at the other end, and head end.

The core 12 and the cover 13 extend along the axis A for substantially the same axial distance. Also, a beam or torsion spring 19 is disposed on the axis A and extends for substantially the mentioned handle full length, and, in fact, it extends slightly beyond the head end of the handle 10, as seen in FIG. 4. The spring 19 has enlarged ends 21 and 22, both being cylindrical, and there is a shoulder 23 on the end 21. An annular member 24 surrounds the spring end 21, and it is preferred that it be tightly affixed with the spring 21, such as by welding thereto. Member 24 has threads 26 which mate with threads 16 to affix the welded assembly of the spring 19 and the member 24 with the handle 10, and the member 24 presents its own shoulder 27 in abutting contact with the shoulder 27 for axial limitation of the two parts. Thus, the unitized spring 19 and member 24 can be inserted into the handle core 12, as shown in FIG. 4, and that screwdriver butt end is then liquid and debris sealed.

The screwdriver head end receives and supports a bushing or sleeve 28 which has a cylindrical portion 29 with splines 31 for press-fitting the bushing into the hollow end of the core 11 and thereby be affixed therewith. It will also be seen that the spring end 22 is snug with the hollow interior of the portion 29, and two O-ring seals 32 are in respective ring groves 33 in the circumference of the spring end 22 and they are between the spring end 22 and the bushing hollow interior. Thus, with the bushing press fit and the seals 32, the head end of the assembly is also liquid and debris tight. The inner end of the bushing 28 abuts the handle shoulder 18 to have the bushing set and fixed axially to the remainder of the handle.

The member 28 also has a circular rim 34 which encloses the head end of the screwdriver. Both ends of the instrument are liquid and debris tight due to the construction shown.

In that aforementioned assembly, the handle with bushing 29 can rotate about the axis A while the spring end 22 is held against rotation, as mentioned hereinafter. That action will put torsional strain in the spring 19, and it is that strain that reveals the amount of torsion being applied to the unshown screw.

A circular cap 36 is on the axis A and on the end of the spring 19. A flat 37 on the spring 19 and a matching flat 38 on the cap 36 contact each other to have the cap 36 absent rotation relative to the spring end 22. The cap 36 has a rim 39 extending over the edge of the bushing 29, and the cap 36 shoulders with the spring 19 at 41. A threaded stud 42 is threadedly connected with the spring end 22 by both having threads at 43, and the stud 42 has a shoulder at 44 to abut the cap 36 and thereby hold the cap 36 against axial movement. In that manner, the cap 36 is axially restrained and is coaxial on axis A.

The stud 42 is like a part of the adapter 11, and the remainder of the adapter is at 46 and is suitable for connecting with an unshown tool.

FIG. 9 shows rotation markings 47 and 48 respectively on the bushing 29 and the cap 36. Additionally, cap 36 has graduation markings and numbers such as shown at 49.

In making the assembly, the cap 36 is rotationally keyed onto the spring end 22, as mentioned, and the assembly can be rotated to align the marking 48 with the marking 47, that is, to set a "zero" starting position. The cap 36 has a hole 50 into which a pin 51 is affixed and the pin 51 extends through the cap 36 and into a slot 52 in the bushing 29. FIG. 29 shows the starting positional relationship of the pin 51 and the slot 52, and it is seen that the pin initially is adjacent an end wall 53, which, along with another end wall 54, the limits of the slot 52 are defined.

In use, it is to be understood that the instrument will exert sufficient rotational torque to initially tighten the unshown screw. When the screw is snugly in its setting, the adapter will then also be firm or confined against liberal rotation about axis A. The handle 10 can still rotate, and the spring end 22 is rotationally restrained, though, by virtue of the narrow central beam length at 56, the beam spring 19 will deflect in torsion at 56 in proportion to the amount of torque being applied to the screw. Of course, the spring end 21 will tend to rotate with the rotation of the handle 10, all about the axis A. That screw-tightening rotation causes the indicia or pointer 47 to rotate relative to the indicia or scale at 49 which is stationary. In that regard, the amount of torque being applied to the screw is indicated and visually apparent on the scale 49. The scale 49 is visible by the user whose hand is restrained by the handle enlargement at 57 to be placed spaced from the scale 49.

If and when rotation is sufficient counterclockwise, as viewed in FIG. 29, movement will be to the scale end designated "25" in inch-pounds. The slot 52 on the handle 10 produces a lost motion rotation and is limited in rotational movement by the wall 54 abutting the stationary pin 51 which remains with the rotational orientation of the workpiece screw. Thus the instrument is protected from damage due to excessive rotational strain. Upon release of the rotation force by the user's hand on the handle 10, the spring 19 reverts to its original condition, that is, there is a return to the "zero" setting, and the next use can be made. Of course, the strength of the spring 19 is that which produces the 25 inch/pounds of torque in this instrument while the handle rotates through the angle to move the wall 53 from contacting one side of the pin 51 and then to have the wall 54 contact the other side of the pin 51.

The method of assembling the screwdriver is disclosed and apparent in the foregoing description. There could be various ways of assembling, such as initially aligning the slot flat side 53 perpendicular with the spring flat 37, as seen in FIG. 29, and then continuing with the remainder of the assembly. Of course, the butt end at the cap 24 should be without rotation freedom relative to the handle 10. One such variation could be pressing the pin 51 into what is the scale 24 and spring 19 assembly can be fully threaded into the handle, and the location of the perpendicular with the spring flat 37 can be marked, such as on the handle cover 13. Then the bushing 28 can be pressed into the handle to have the slot slot side 53 aligned with the mark and/or to have the slot side 53 perpendicular with the spring flat 37. That assembly of the spring 19 and the cap 24 can then be removed from the handle and the O-rings 32 can be mounted. A threaded locking material can be applied to the threads 16 and 26, and the assembly can be placed back into the handle with the alignment mentioned. Thread locking material can be applied to the threads at 43 and the scale plate 36 and stud 42 or the like can be positioned and tightened. Arrow markings of 47 and 48 are mutually aligned at final assembly.

It should be apparent to one skilled in the art that changes can be made in the embodiment and method disclosed herein, and the invention should be construed by the scope of the appended claims. For instance, the relationship and attachment of the spring ends with the handle could be different from that shown herein.

What is claimed is:

1. A screwdriver assembly for rotationally driving a tool to thereby threadedly connect a workpiece screw and having a torque measuring scale, comprising:

a screwdriver handle having an elongated axis and a first end and a second end with said ends spaced apart on said axis and said handle having a hollow interior between said ends, a member connected to said handle first end to be without rotation relative to said handle and a cap connected to said handle second end and being rotatable about said axis and relative to said handle, said cap and said member being spaced apart along said axis, a beam spring disposed in said handle interior and extending axially therealong and being completely fully disposed within the spacing between said member and said cap and having two ends respectively adjacent said handle ends and having a first one of said spring ends fixedly connected to said member to be without rotation relative to said handle and having a second one of said spring ends fixedly non-rotatably connected to said cap to be rotatable relative to said handle, a tool attaching member connected to said spring at said second end of said spring and being capable of holding said second end of said spring against rotation in an initial position in response to tightening the workpiece screw, a torque scale and a marker respectively connected with said cap and said handle and being coaxially disposed on said axis and having an initial marking aligned with said initial position, and one of said scale and said marker rotatable with said handle for indicating the amount of rotation of said handle beyond said initial position upon tightening the workpiece screw.

2. A screwdriver with a scale for measuring torque transmitted to a workpiece screw, comprising:

a handle having a longitudinal axis and a hollow interior extending along said axis, a beam-type spring disposed in said hollow interior and having two ends with a first one of said ends affixed to said handle and a second one of said ends being connectable to the screw and with said handle being rotationally free of said spring second end for rotation of said handle relative to said spring second end, indicia on the screwdriver and respective to both said handle and said spring for measuring the relative rotation between said handle and said spring second end when the screw resists rotation, a lost motion connection interposed between said handle and said spring to accommodate the relative rotation, a limit stop included in said lost motion connection for stopping the relative rotation, and said lost motion and said limit stop including a slot with two spaced-apart end walls and a pin in said slot and said pin and said slot being inter-related for relative movement between said pin and said walls for lost motion therebetween and for limiting the motion therebetween.

3. A screwdriver with a scale for measuring torque transmitted to a workpiece screw, comprising:

a handle having a longitudinal axis and a hollow interior extending along said axis, an elongated beam-type spring disposed in said hollow interior and extending on said axis and having two ends with a first one of said ends permanently affixed to said handle and a second one of said ends being connectable to the screw for rotation of said handle relative to said second end, indicia on the screwdriver and respective to both said handle and said spring and said indicia having two spaced-apart end limits thereon and being rotationally movable between said limits and including a zero setting at a first one of said end limits and a maximum numerical reading at a second one of said end limits for measuring the relative rotation between said handle and said spring when the screw resists rotation and thereby display the amount of torque being applied through said spring, a lost motion connection interposed between said handle and said spring to accommodate the relative rotation, and a limit stop included in said lost motion connection for stopping the relative rotation.

4. The screwdriver with a scale for measuring torque transmitted to a workpiece screw, as claimed in claim 3, including:

a bushing in said handle for rotationally supporting said second end of said spring on said handle.

5. The screwdriver with a scale for measuring torque transmitted to a workpiece screw, as claimed in claim 4, wherein:

said bushing has a press fit in said handle to be rotationally fixed with said handle.

6. The screwdriver with a scale for measuring torque transmitted to a workpiece screw, as claimed in claim 5, wherein:

said bushing includes said lost motion connection and said limit stop.

7. The screwdriver with a scale for measuring torque transmitted to a workpiece screw, as claimed in claim 3, wherein:

said indicia between said spaced-apart locations a graduated scale non-rotationally related to said spring second end and said indicia includes a pointer related to said handle and disposed adjacent said scale for rotational movement along with the rotation of said handle and thereby measure the torque applied to the screw.

8. The screwdriver with a scale for measuring torque transmitted to a workpiece screw, as claimed in claim 3, including:

a seal between said handle and said spring second end for precluding entry of matter into said handle hollow interior.

9. The screwdriver with a scale for measuring torque transmitted to a workpiece screw, as claimed in claim 3, including:

a screwdriver bit adapter, and a member non-rotationally attachable to said adapter and having said scale thereon and being supportable on said handle with relative rotational relationship between said member and said handle.

10. A method of assembling a screwdriver having a torque measuring scale thereon, comprising the steps of:

providing a torsion spring elongated on and along an axis and having two terminal ends on said spring axis, providing a handle with a longitudinal axis and a hollow interior extending along said longitudinal axis and with two ends respectively adjacent said spring two ends to be co-extensive with said handle along said axis, inserting said spring into said handle to have said axes coaxial, permanently fixedly anchoring a first one of said spring ends with a first one of said handle ends for common rotation together, positioning a second one of said spring ends adjacent a second one of said handle ends and having said seconds ends rotatable relative to each other about said axes, connecting a member to said second one of said spring ends for precluding rotation of said spring second end about said axes, attaching a rotation stop operative between said member and said handle and having an initial rotational zero setting position, and placing inter-cooperative scale indicia on both said second end of said handle and relative to said member and having zero setting indicia for revealing said initial position and for revealing the torque being transmitted by the screwdriver.

11. A method of assembling a screwdriver having a scale for measuring torque applied to a screw, comprising the steps of:

providing a handle with a longitudinal axis and a hollow interior extending along said axis, positioning a spring with two ends in said hollow interior and having said spring extend on and along said axis and having a permanently affixed non-rotational connection with said handle at a first one of said spring ends and having a rotational relationship with said handle at a second one of said spring ends, providing a rotational lost-motion connection between said handle and said second one of said spring ends and having an initial rotational setting relationship therebetween, positioning indicia relative to said connection and having a zero setting when said handle and said second spring end are in said initial rotational relationship, for measuring the rotational lost motion away from said initial rotational relationship to thereby measure torque transmitted to the screw, and providing a rotation stop operative on said handle and said spring second end for limiting the amount of lost motion.

12. A method of assembling a screwdriver having a scale for measuring torque applied to a screw, comprising the steps of:

providing a handle with a longitudinal axis and a hollow interior extending along said axis, positioning a spring with two ends in said hollow interior and having said spring extend on and along said axis and having a non-rotational connection with said handle at a first one of said spring ends and being arranged for a rotational relationship with said handle at a second one of said spring ends, marking a location on said handle relative to a final assembled orientation of said spring in said handle, removing said spring from said handle and affixing a spring holder with said spring first end, re-positioning said spring in said handle and aligning said spring with said marking and connecting said holder with said handle, providing a rotational lost-motion connection between said handle and said second one of said spring ends, positioning indicia relative to said connection for measuring the rotational lost motion to thereby measure torque transmitted to the screw, and providing a rotation stop operative between said spring second end and said handle for limiting the amount of lost motion.

13. The method of assembling a screwdriver having a scale for measuring torque applied to a screw, as claimed in claim 12, including the step of:

providing a bushing arranged with said rotation stop and inserting said bushing into said handle to be adjacent said second end of said handle and aligning said bushing with said marking.

14. The method of assembling a screwdriver having a scale for measuring torque applied to a screw, as claimed in claim 13, including the step of:

sealing both said handle ends against entry of debris into said handle interior.

* * * * *